US009433846B2

(12) United States Patent
Lynch et al.

(10) Patent No.: US 9,433,846 B2
(45) Date of Patent: Sep. 6, 2016

(54) GOLF TRAINING APPARATUS

(71) Applicants: Charles E. Lynch, Palatine, IL (US); Eric R. Fox, Chicago, IL (US)

(72) Inventors: Charles E. Lynch, Palatine, IL (US); Eric R. Fox, Chicago, IL (US)

( * ) Notice: Subject to any disclaimer, the term of this patent is extended or adjusted under 35 U.S.C. 154(b) by 0 days.

(21) Appl. No.: 14/827,260

(22) Filed: Aug. 14, 2015

(65) Prior Publication Data

US 2016/0045804 A1 Feb. 18, 2016

Related U.S. Application Data

(60) Provisional application No. 62/037,776, filed on Aug. 15, 2014.

(51) Int. Cl.
*A63B 69/36* (2006.01)

(52) U.S. Cl.
CPC ..... *A63B 69/36* (2013.01); *A63B 69/3641* (2013.01); *A63B 69/3676* (2013.01); *A63B 2208/0204* (2013.01)

(58) Field of Classification Search
CPC ..... A63B 69/3676; A63B 69/3641
USPC ..... 473/219, 226, 257, 258, 260, 261, 263, 473/264, 265
See application file for complete search history.

(56) References Cited

U.S. PATENT DOCUMENTS

| | | | | |
|---|---|---|---|---|
| 2,084,901 A * | 6/1937 | Eisenberg | A63B 69/3676 | 473/229 |
| 5,301,949 A * | 4/1994 | Aupied | A63B 69/3676 | 473/265 |
| 5,501,452 A * | 3/1996 | Halvorson | A63B 69/3676 | 473/260 |
| 6,699,141 B1 * | 3/2004 | Florian | A63B 69/3641 | 473/257 |

* cited by examiner

*Primary Examiner* — Nini Legesse
(74) *Attorney, Agent, or Firm* — Clifford H. Kraft

(57) ABSTRACT

A device that helps a golfer improve their swing by providing a track over which to swing the club, a strike plate which swivels to keep contact with the club as long as possible and a resistance to movement over the strike plate in the track so the player understands the weight transfer required in a golf swing. An embodiment includes a sled sliding on at least one rail with front and rear strike plates and a center resistance mechanism that provides adjustable resistance to the swing using pads to contact the rails. The user can set different ranges of resistance.

19 Claims, 15 Drawing Sheets

GOLF TRAINING APPARATUS

This application claims priority from U.S. Provisional Patent Application No. 62/037,776 filed Aug. 15, 2014. Application 62/037,776 is hereby incorporated by reference in its entirety.

BACKGROUND

1. Field of the Invention

The present invention relates generally to sports training devices and more particularly to a golf training apparatus that helps a golfer feel and understand the movement through impact and thus improve their swing.

2. Description of the Prior Art

Golfers typically need improvement in their consistency on the course. This means improving their accuracy and distance control. There are disparate devices that purport to do this by improving alignment, swinging a weighted or contrived club, or mechanically contorting the golfer into supposedly correct positions during the swing. It would be advantageous to have a device that combines alignment with proper swing mechanics of the take-away, hinging, and backswing turn, thus demonstrating proper club-ball contact in the down-swing, all the while promoting a proper weight shift that is critical to a successful golf swing.

SUMMARY OF THE INVENTION

The present invention is a device that helps a golfer improve their swing by providing a track over which to swing the club, a strike plate which swivels to keep contact with the club as long as possible and a resistance to movement over the strike plate in the track so the player understands the weight transfer required in a golf swing. An embodiment includes a sled sliding one or more rails with a front and rear strike plate and a resistance mechanism that provides adjustable resistance to the swing using at least one pad attached to the sled to contact the rail. The user can set different ranges of resistance as training proceeds. A golfer using the invention encounters one of the strike plates on the backswing and another of the strike plates on a foreswing.

DESCRIPTION OF THE FIGURES

Attention is now directed to several drawings that illustrate features of the present invention.

Several drawings and illustrations have been presented to aid in understanding the present invention. The scope of the present invention is not limited to what is shown in the figures.

DESCRIPTION OF THE PREFERRED EMBODIMENTS

Figure 1:
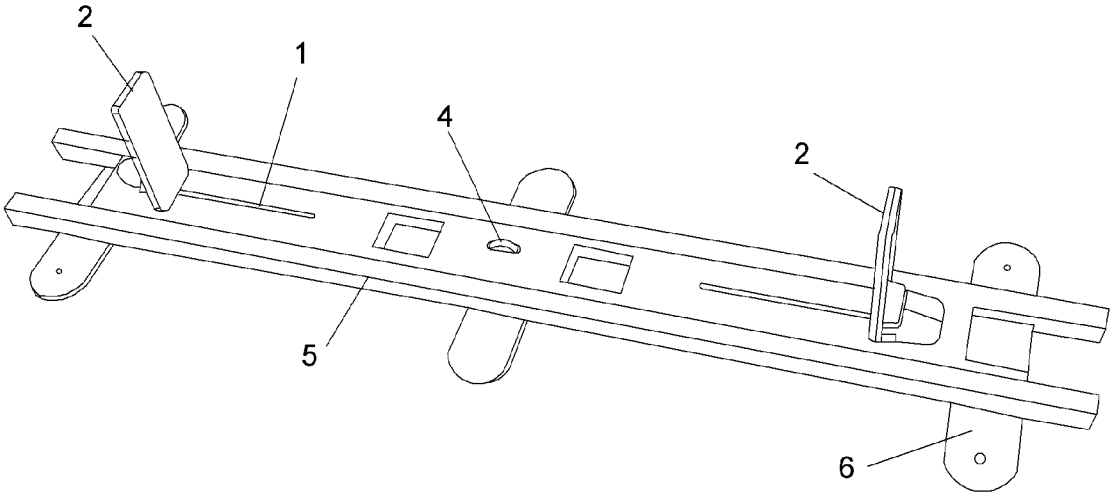
FIG. 1 shows a top perspective view of an embodiment of the present invention.

FIG. 1 shows an embodiment of the present invention. The apparatus includes a frame and a sliding sled section with two raised plates. The device is secured to a base (which can be further secured to a floor), and the golfer stands next to it. He engages the first plate on the backswing and the second plate on the foreswing. The plates and sliding sled section slide during the swing providing an adjustable resistance. The plates swivel about a vertical axis for about 10 to 20 degrees total to help maintain maximum contact with the club.

Figure 2:
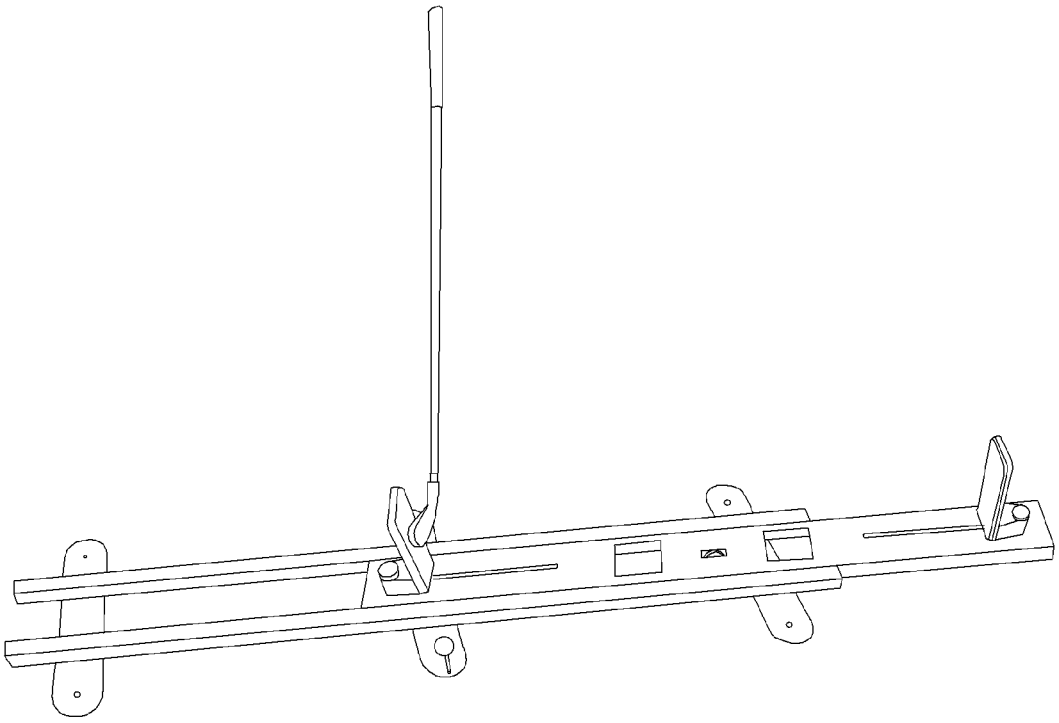
FIG. 2 shows a golfer using the present invention. The golfer is just beginning a swing.
Figure 3:
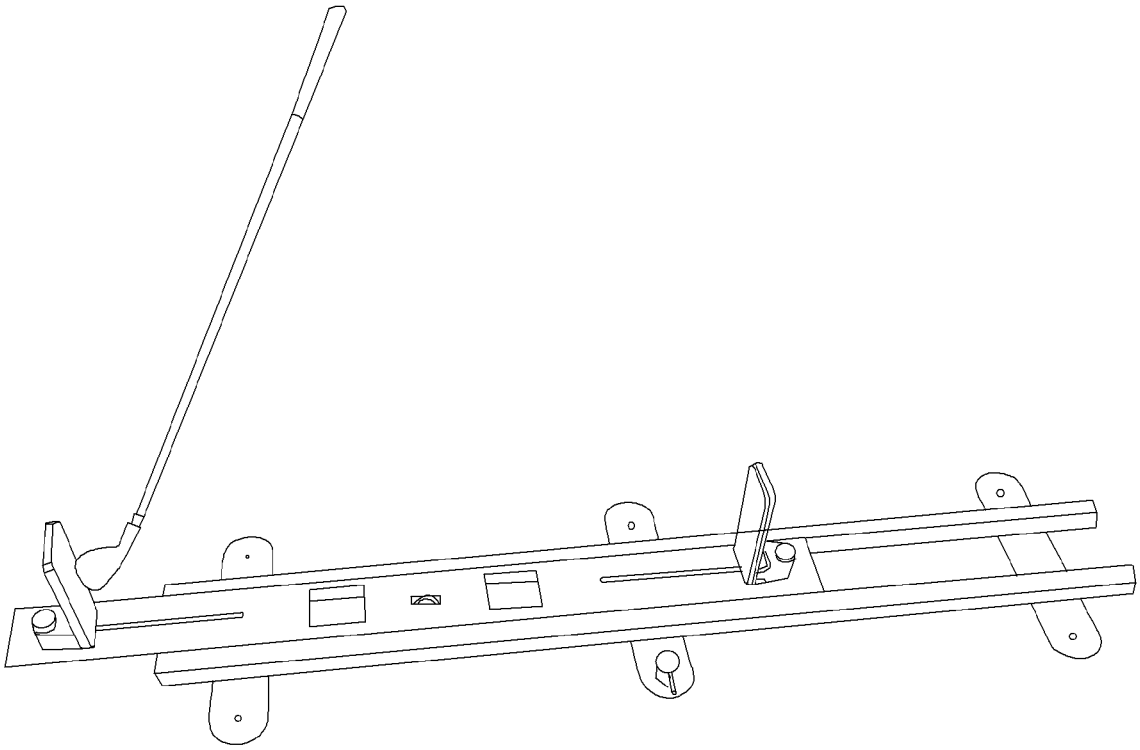
FIG. 3 shows the backstroke against resistance.
Figure 4:
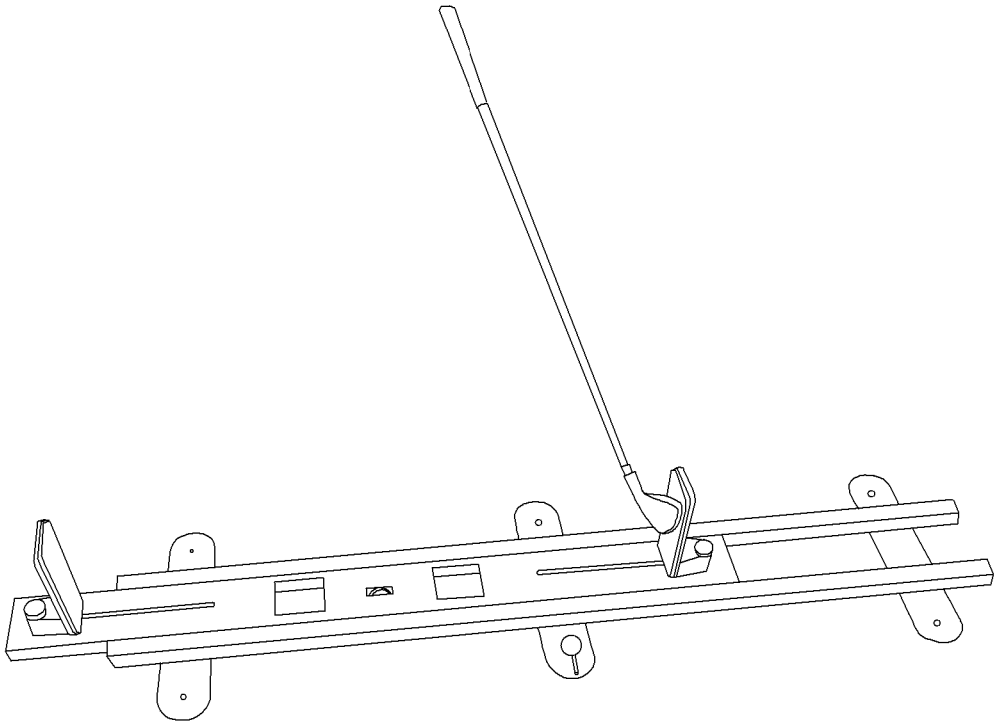
FIG. 4 shows the forestroke against resistance.

FIGS. 2-4 show the start, backswing and foreswing positions of the sliding sled section and the posts. The golfer moves the sled backward against resistance by contacting the rear strike plate during the backswing before the club rises above the device. On the foreswing, the club encounters the forward strike plate and moves forward against resistance until once again the club rises above the apparatus.

In FIG. 2, the golfer aligns himself or herself with the device and places the club against the rear strike plate. In FIG. 3, he next completes the backswing. This causes the sled and strike plates to move in a rearward direction against resistance. The golfer then completes the backswing raising the club off of the apparatus and begins the foreswing as shown in FIG. 4. The club encounters the forward strike plate and moves it forward along with the rails with the sled again against resistance. The golfer then completes the foreswing raising the club off of the apparatus. The exercise requires accuracy, and because the movement of the strike plates is against an adjustable resistance, the strength of the swing is increased.

Figure 5:
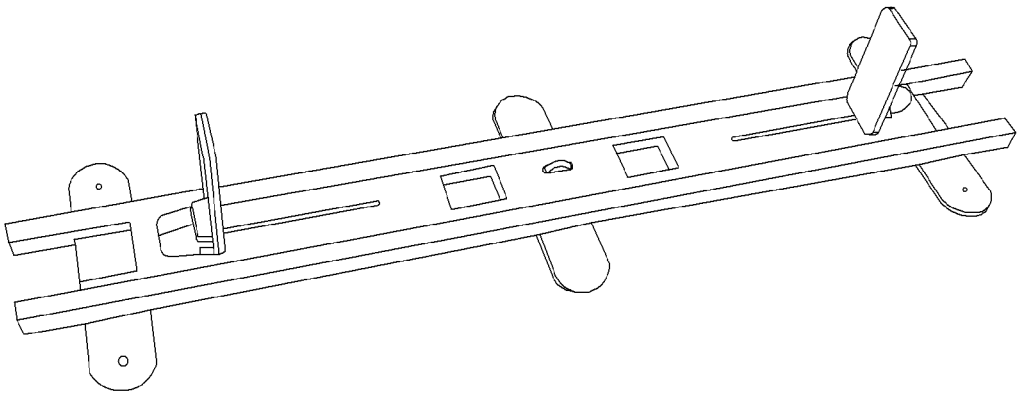
FIG. 5 is a different perspective view of the embodiment of FIG. 1.

FIG. 5 shows the embodiment from a different angle.

Figure 6:
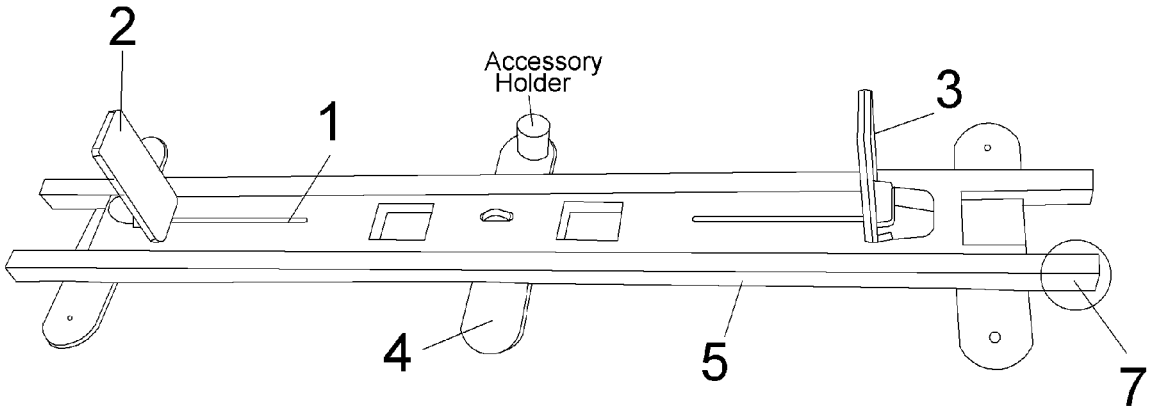
FIG. 6 shows the components of the embodiment of FIG. 1.

FIG. 6 shows different parts of the assembly. A sled 1 is attached to a rear strike plate 2 and a front strike plate 3. The strike plate assembles can swivel through a predetermined angle of from approximately 5 degrees on each side of center to approximately 10 degrees each side of center to allow maximum contact with a golf club. A variable resistance center section 4 moves with the sled 1 and causes an adjustable amount of resistance. The sled slides on rails 5 that are attached to the main base 6. Each end has a sled stop 7 that prevents the sled 1 from leaving the rails 5.

Figure 7:
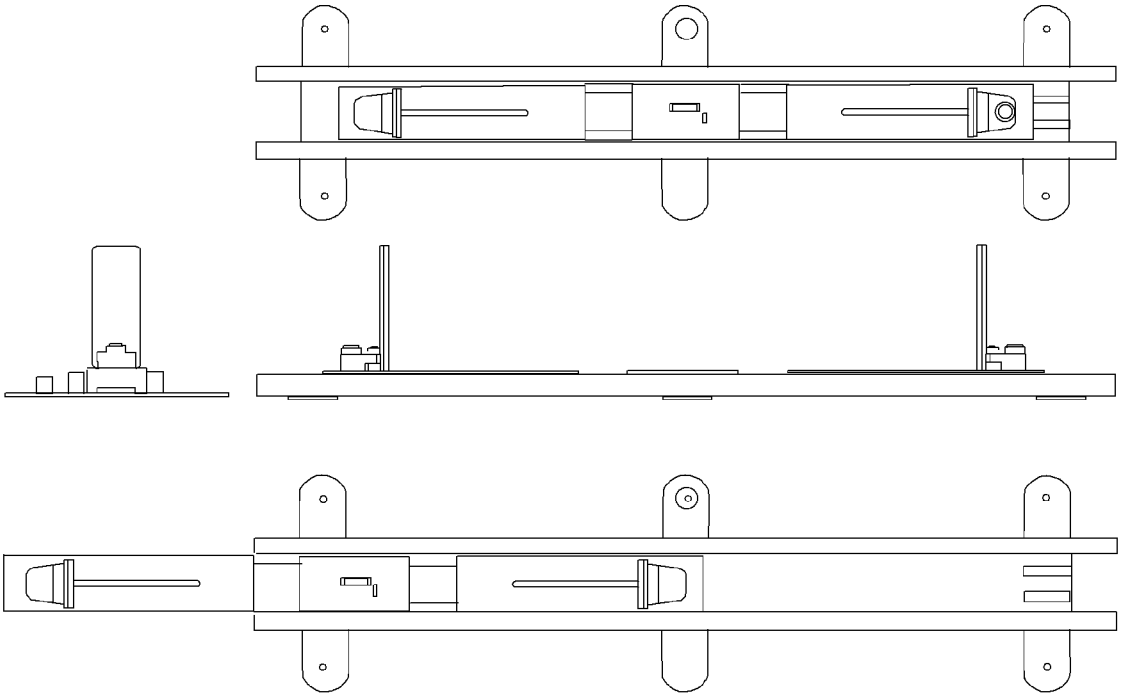
FIG. 7 shows different positions of the slider on the rails.

FIG. 7 shows the base 6, rails 5 and the sled 1 in different positions. The preferred length of the rails is approximately 56 inches with approximately 40 inches of travel on either side of center. These preferred dimensions are given for example only. Numerous other dimensions are within the scope of the present invention.

Figure 8:
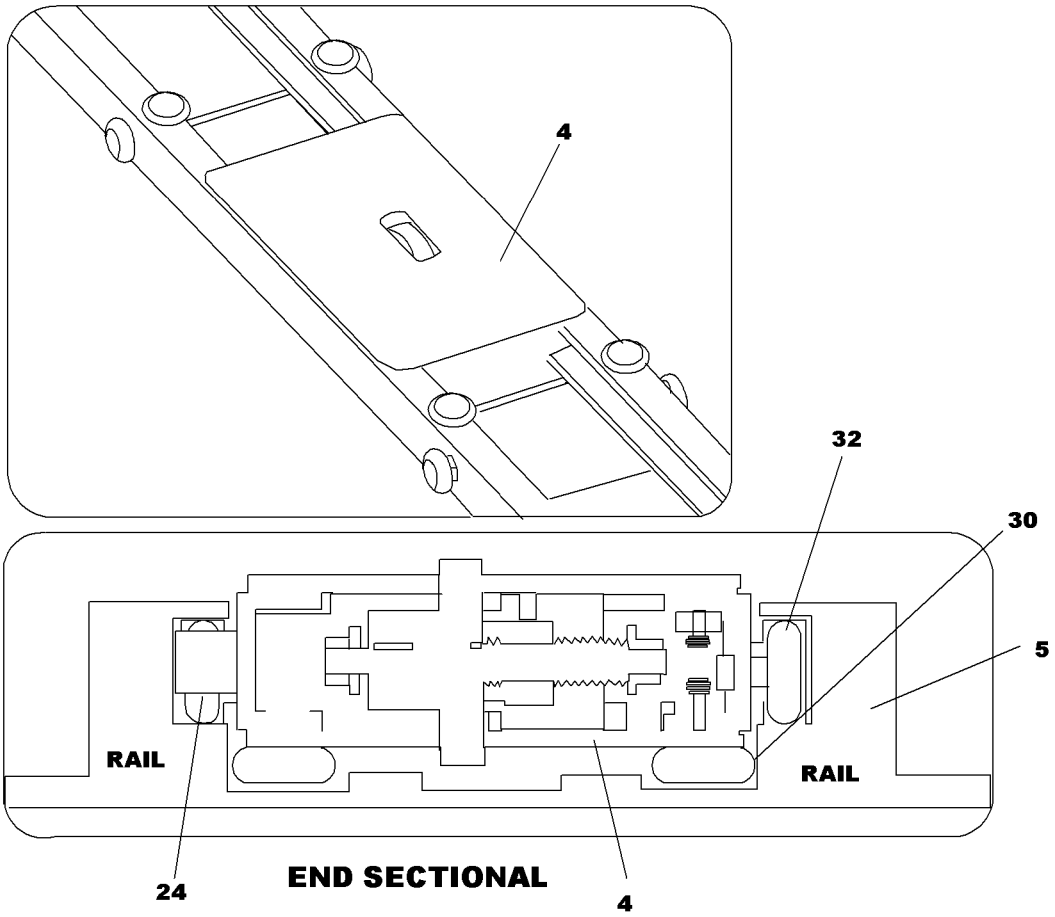
FIG. 8 shows details of a resistance mechanism.

Adjustable resistance is provided by one or more resistance pads that slide and create friction against the rails as shown in FIG. 8. The resistance pads are spring biased so that Increasing spring tension increases resistance. The resistance mechanism 4 can also include a set of rollers that bias the sled to the opposite side causing the rollers to ride against the outer rails. Bottom rollers 30 can be seen in FIG.

8. There are also side rollers 32 on the side opposite to the resistance pads 24. The rails 5 can be seen.

Figure 9:
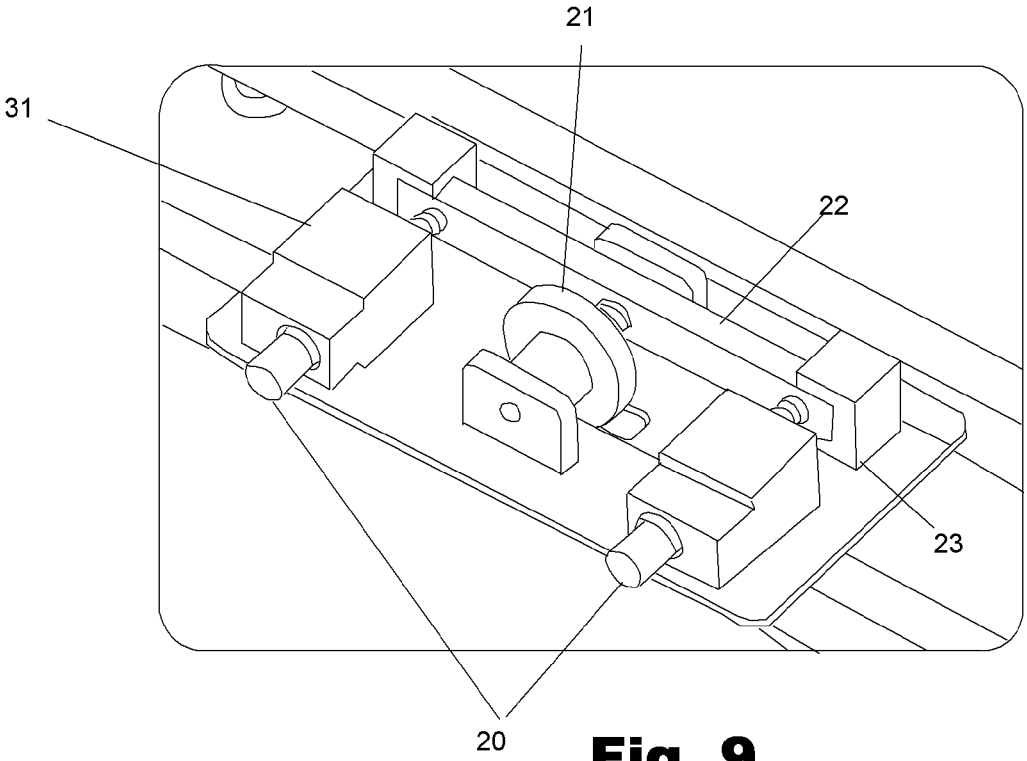
FIG. 9 shows how the resistance mechanism is adjustable.

FIG. 9 shows a broken-away view of the resistance pads 24. A knob 21 or other control is used to adjust resistance by moving a bar 22 or other member against the springs 23 forcing the pads 24 more tightly against the rail. There can also be an optional pad cover 31.

Figure 10:
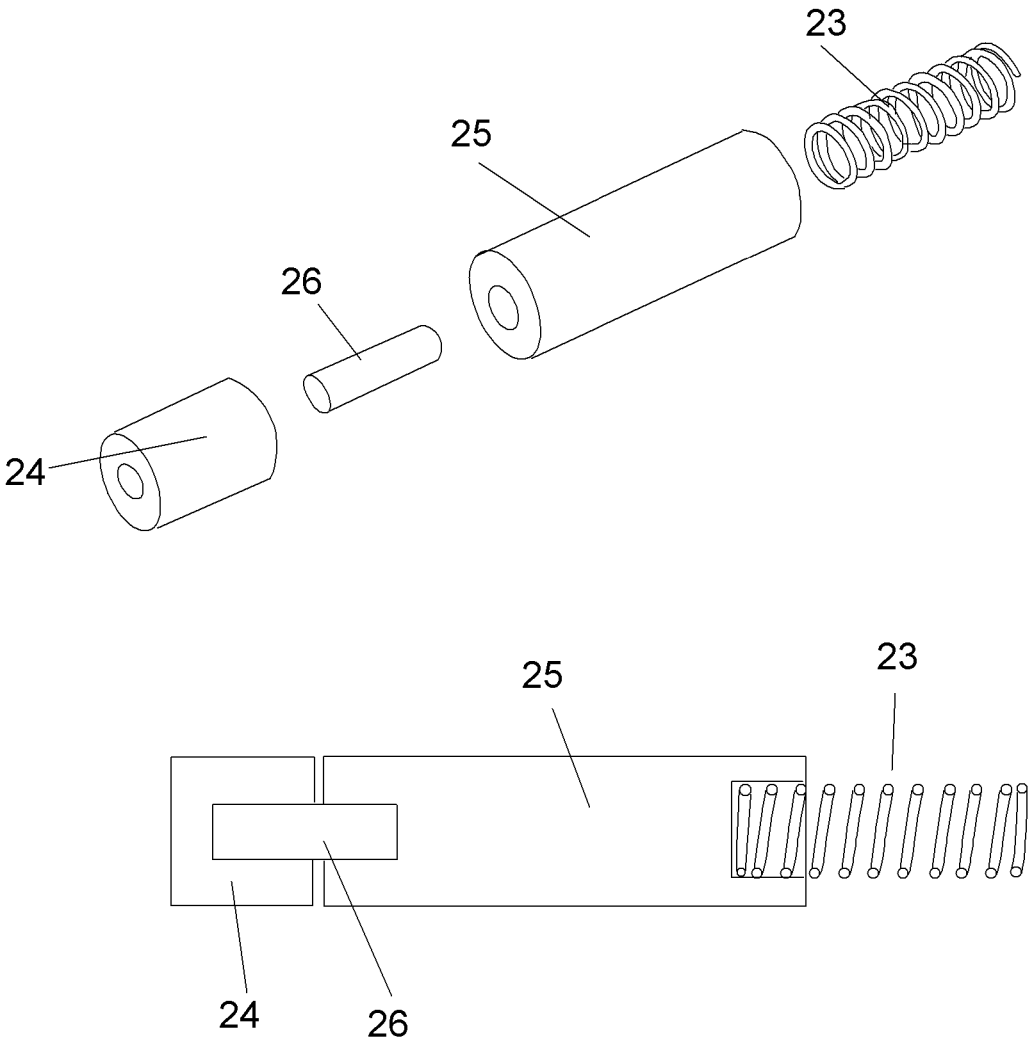
FIG. 10 shows details of the resistance pad and biasing springs.

FIG. 10 shows a detail of the pad assembly. The pad 24 is attached to a push rod 25 by a dowel pin 26. The push rod 25 is driven by the spring 23. The resistance pad 24 can be removed and is replaceable.

Figure 11:
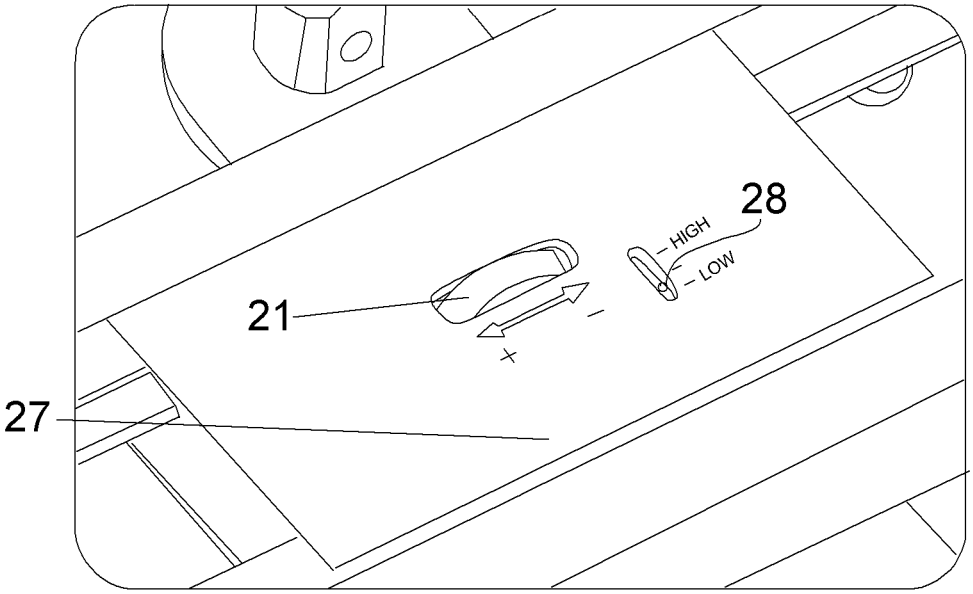
FIG. 11 shows an optional resistance range adjustment.

FIG. 11 shows an optional force range selection switch 27. This sliding switch presets a bias into the springs effectively shifting the range of the knob 21. An optional indicator 28 shows the level of resistance chosen.

Figure 12:
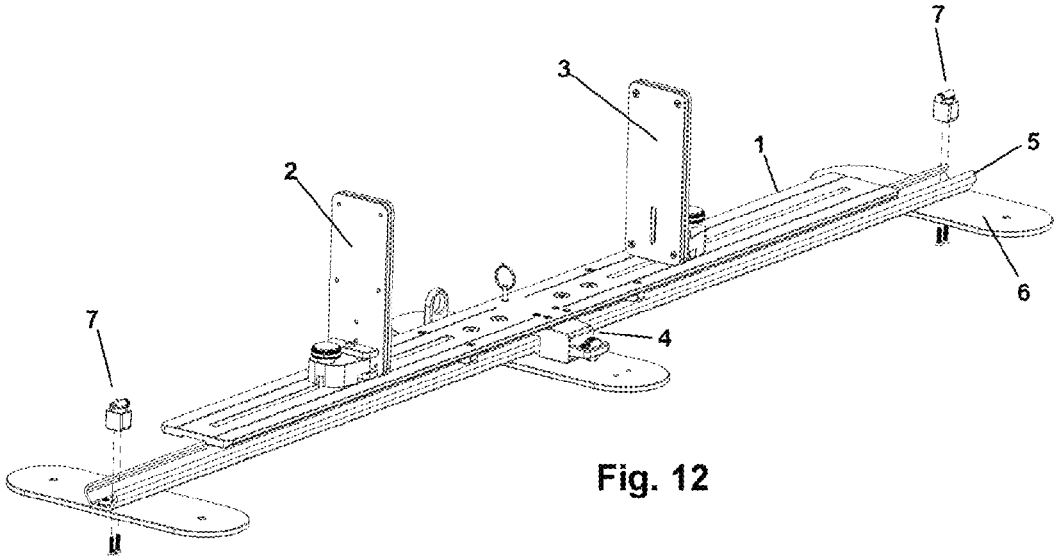
FIG. 12 shows an alternate embodiment of the invention with a single rail.

FIG. 12 shows an alternate embodiment of the present invention. This embodiment only has a single rail. The sled 1 slides on the single rail 5 that is secured to the base 6. The rear 2 and front 3 strike plates can be seen in FIG. 12. Each end of the rail 5 has a stop or bumper 7 that prevents the sled 1 from leaving the rail. The resistance mechanism 4 can be seen on the side of the sled 1 between the strike plates.

Figure 13:
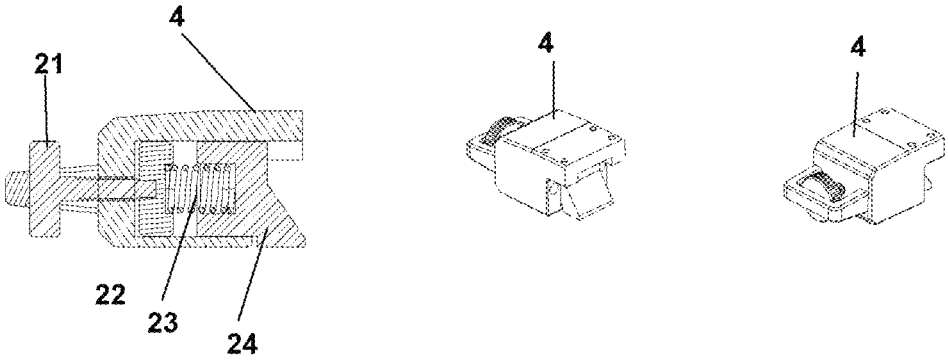
FIG. 13 shows the resistance mechanism in the embodiment of FIG. 12.

FIG. 13 shows a detail of the modified resistance mechanism 4 of the embodiment of FIG. 12. The pad 24, spring 23 and bar 22 can be seen. A resistance adjustment knob 21 is also visible.

Figure 14:
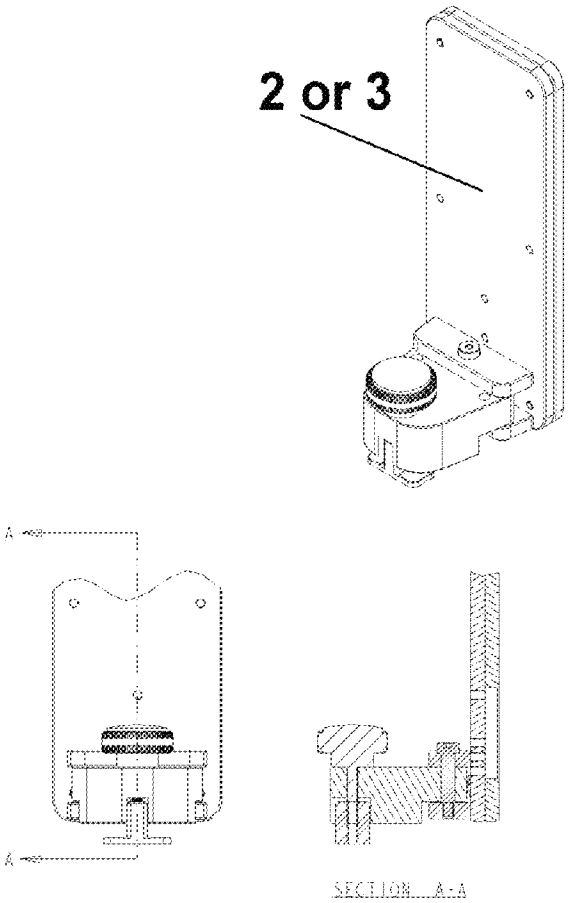
FIG. 14 shows details of the front or rear strike plate in this embodiment.
Figure 14:
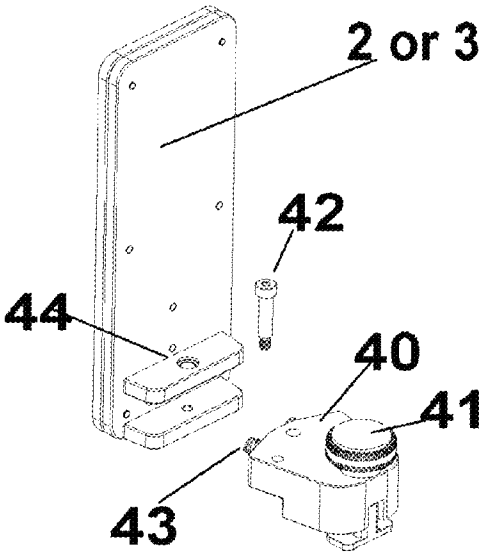

FIG. 14 shows details of the rear 2 or front 3 strike plates in the embodiment of FIG. 12. The plates are attached to a clamp 40 by a pin 42 that passes through a flange 44. The plate engages two springs 43 on the front of the clamp 40. The front of the clamp 40 slants away in two directions allowing the plate 2,3 to swivel around the pin 42 through the predetermined angle.

Figure 15:
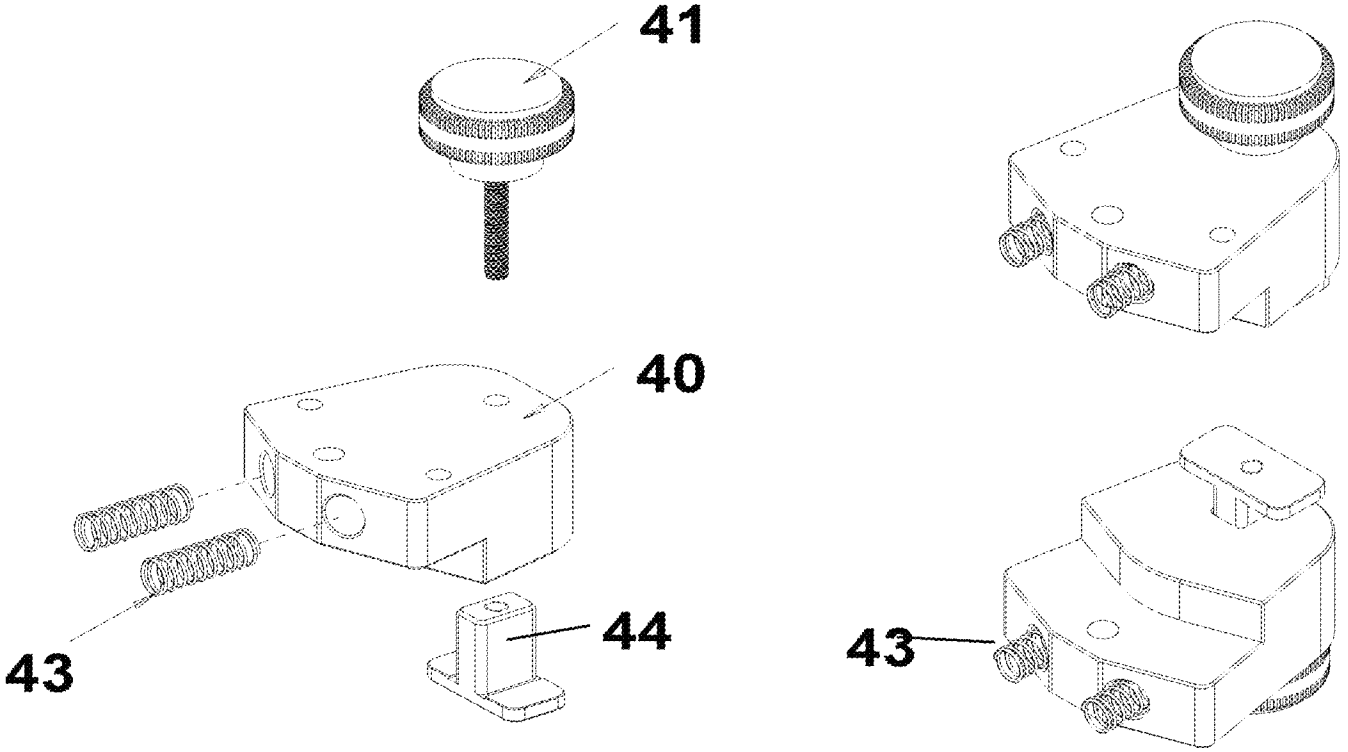
FIG. 15 shows details of the swivel mechanism for the strike plates in this embodiment.

FIG. 15 shows a detail of the clamp 40 in this embodiment. A knob 41 with a screw holds the clamp 40 to a base 44 which can be screwed to the sled. The faces of the clamp 40 slant at an angle and each receives a spring 43. This allows the plate 2, 3 to swivel about the pin 42.

The present invention provides an economical golf training tool that simultaneously increases swing length, swing coil, swing accuracy, and increases swing strength.

Several descriptions and illustrations have been presented to aid in understanding the present invention. One with skill in the art will realize that numerous changes and variations may be made without departing from the spirit of the invention. Each of these changes and variations is within the scope of the present invention.

We claim:

1. A golf training apparatus comprising an elongated base with at least one fixed rail and a sliding sled portion that rides on the rail, the sled portion including at least one resistance pad that provides resistance against the rail as the sled portion moves, the sled portion also including a pair of separated upright strike plates that swivel through a predetermined angle about a pin, whereby a golfer can encounter one of the strike plates on a backswing and another of the strike plates on a foreswing moving the sled portion against the resistance pad.

2. The golf training apparatus of claim 1 wherein the resistance pad is configured to provide adjustable resistance.

3. The golf training apparatus of claim 1 wherein the resistance pad is replaceable.

4. The golf training apparatus of claim 1 further comprising an adjustment knob adapted to be adjusted from a first resistance to a second resistance, the second resistance being greater than the first resistance.

5. The golf training apparatus of claim 4 further comprising a switch configured to choose an absolute value of the first and second resistance.

6. The golf training apparatus of claim 4 wherein the resistance pad is raised against the rail by a spring.

7. The golf training apparatus of claim 6 wherein the spring is adjusted in bias by the adjustment knob.

8. The golf training apparatus of claim 1 wherein the rail, sled and strike plates are aluminum.

9. A golf training apparatus comprising:

at least one horizontal elongated parallel rail mounted on a base;

a sled configured to travel horizontally along said rail over the base fore and aft;

a rear strike plate attached to a first end of the sled, the rear strike plate being a flat vertical plate member perpendicular to said rail and configured to swivel through a predetermined angle about a vertical axis;

a front strike plate attached to a second end of the sled, the second strike plate also being a flat vertical plate member perpendicular to said rail and configured to swivel through the predetermined angle about the vertical axis;

a resistance member located on said sled, the resistance member having at least one pad biased by a spring to make friction contact with of said rail providing an adjustable resistance to movement of the sled according to the spring bias;

a control configured to adjust the spring bias between a first bias and a second bias, wherein the second bias is greater than the first bias.

10. The golf training apparatus of claim 9 further comprising a switch configured to offset the spring bias so the first and second bias is decreased or increased.

11. The golf training apparatus of claim 9 wherein the pad is biased by an adjustable spring.

12. The golf training apparatus of claim 9 wherein the base, rail and sled are aluminum.

13. The golf training apparatus of claim 9 wherein the pad is replaceable.

14. The golf training apparatus of claim 9 including two pads and two springs.

15. The golf training apparatus of claim 9 further comprising a horizontal member in contact with the spring, wherein the horizontal bar is adjustable with a set screw to increase or decrease the spring bias.

16. The golf training apparatus of claim 15 wherein the set screw is rotated with the knob.

17. A method of providing a golf training apparatus comprising:

providing at least one horizontal elongated rail mounted on a base;

providing a sled configured to travel horizontally along said rail over the base fore and aft;

providing a rear strike plate attached to a first end of the sled, the rear strike plate being a flat vertical plate member perpendicular to said rail;

providing a front strike plate attached to a second end of the sled, the front strike plate also being a flat vertical plate member perpendicular to said rail;

providing a resistance member located on said sled between the front and rear strike plates, the resistance member having at least one pad biased by a spring to contact said rail providing an adjustable resistance to movement of the sled according to the spring bias;

providing a control configured to adjust the spring bias between a first bias and a second bias, wherein the second bias is greater than the first bias.

18. The method of claim 17 comprising providing two pads and two springs.

19. The method of claim 17 further comprising providing a horizontal member in contact with the spring, wherein the horizontal bar is adjustable with a set screw to increase or decrease the spring bias.

* * * * *